US005997201A

United States Patent [19]

Bossert et al.

[11] Patent Number: 5,997,201

[45] **Date of Patent: *Dec. 7, 1999**

[54] HOLDER FOR A STICK OF A SPREADABLE SUBSTANCE

[75] Inventors: Marie Claude Bossert, Erkrath; Joachim Franken, Duesseldorf, both of Germany; Johan Wouters; Johannes Hubertus Jozef Maria Kelders, both of Drunen, Netherlands

[73] Assignee: Henkel Kommanditgellschaft Auf Aktien (KGaA), Duesseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/556,959

[22] PCT Filed: Jun. 10, 1994

[86] PCT No.: PCT/NL94/00137

§ 371 Date: Mar. 12, 1996

§ 102(e) Date: Mar. 12, 1996

[87] PCT Pub. No.: WO94/28760

PCT Pub. Date: Dec. 22, 1994

[30] Foreign Application Priority Data

Jun. 11, 1993 [NL] Netherlands ..... 9301019

[51] Int. Cl.[6] ..... A45D 40/04; A45D 40/16

[52] U.S. Cl. ..... 401/75; 401/86; 401/87; 401/97; 401/134; 401/175; 222/326; 222/327

[58] Field of Search ..... 401/68, 69, 70, 401/72, 75, 77, 78, 79, 56, 96, 97, 88, 132–135, 172–175, 55, 58, 59, 73, 76, 82, 83, 85, 86, 87, 89, 90, 92; 222/326, 327

[56] References Cited

U.S. PATENT DOCUMENTS

| | | | |
|---|---|---|---|
| 1,876,797 | 9/1932 | Treleven | 222/326 |
| 1,907,376 | 5/1933 | Weck | 222/327 X |
| 2,079,744 | 5/1937 | Maguire | 222/326 |
| 2,421,246 | 5/1947 | Davis | 401/96 |
| 2,589,000 | 3/1952 | Vani | 401/55 |
| 2,625,302 | 1/1953 | Mahoney | 401/135 X |
| 2,717,101 | 9/1955 | Van Handel | 401/132 X |
| 2,720,966 | 10/1955 | Davis | 401/97 X |
| 2,770,358 | 11/1956 | Keith | 401/97 X |
| 3,358,699 | 12/1967 | Bau | 401/70 |
| 3,828,802 | 8/1974 | Spanel | 401/82 X |
| 4,019,654 | 4/1977 | Van Manen | 222/327 X |
| 4,182,915 | 1/1980 | Harvey | 568/716 |
| 5,009,534 | 4/1991 | Gueret | 401/75 |
| 5,195,555 | 3/1993 | Knapp | 137/454.6 |
| 5,336,005 | 8/1994 | Moeck et al. | 401/70 X |
| 5,567,071 | 10/1996 | Lepsius et al. | 401/68 |

FOREIGN PATENT DOCUMENTS

| | | | |
|---|---|---|---|
| 0391862 | 10/1990 | European Pat. Off. . | |
| 0395914 | 11/1990 | European Pat. Off. . | |
| 942379 | 2/1949 | France | 401/85 |
| 1049134 | 12/1953 | France . | |
| 6616056 | 5/1967 | Netherlands . | |
| WO9015762 | 12/1990 | WIPO . | |

*Primary Examiner*—Danton D. DeMille
*Attorney, Agent, or Firm*—Wayne C. Jaeschke; Glenn E.J. Murphy; Kenneth K. Watov

[57] ABSTRACT

A device for holding a stick or rod of spreadable material includes a sleeve or container open on one side, an element co-acting with the stick, and a hand-operated means for varying the distance between the edge of the open side of the sleeve and the stick element. The stick or rod of spreadable material can be an adhesive stick or a wax stick. The stick of spreadable material is packaged separately from the device in an envelope of thin material, and the container includes means for securely holding an envelope of thin material suitable for packaging the stick.

8 Claims, 7 Drawing Sheets

HOLDER FOR A STICK OF A SPREADABLE SUBSTANCE

BACKGROUND

1. Field of the Invention

The invention relates generally to a device for holding a stick or rod of spreadable material such as an adhesive stick, wax stick and the like, whereby a manually actuated mechanism of the device permits a user to extend a portion of the stick from an associated container for application of a spreadable material to a surface.

2. Discussion of Related Art

Known devices for holding a stick of spreadable material may include a sleeve not only as container but also as packaging for the spreadable material. Once the material is used up the whole container is discarded, causing an environmental impact.

SUMMARY OF THE INVENTION

An object of the invention is to provide a device of the type described in the preamble which can be reused a number of times, i.e. that it is refillable and that the consumer can replace the stick.

The device according to the invention is distinguished by hand-operated means for varying the distance between the edge of the open side of the sleeve and the stick element.

Due to the option of varying the distance between the edge of the open side of the sleeve and the stick element with the hand-operated means, it is possible each time the stick is used up for a new stick to be arranged on the stick element and pushed into the sleeve, whereafter the stick can be used up once again.

In one embodiment of the invention the sleeve includes mutually stackable annular parts which are removable so that a new part of the stick for use is exposed each time. When a new stick is introduced the sleeve can be built up again from the rings or annular parts previously removed.

According to another embodiment the stick element is a pusher body for sliding in the sleeve, which in a further embodiment is connected to pulling or pushing strips, which are moved by a hand-operated member accessible from outside the sleeve.

According to a further embodiment the pusher body is embodied as a nut body, wherein the hand-operated element is a screw spindle which is mounted in the sleeve, and which is carried through a central hole of the nut. By turning the screw spindle the pusher body can be carried up and downward through the sleeve, while carrying and moving with it the stick arranged therein.

According to a further embodiment of the invention, the stick is packaged separately in an envelope of thin material, for instance a plastic foil, wherein the sleeve is provided with means for securely holding the foil.

The separate packing material for the stick can be made from relatively inexpensive and easily recyclable material. It can be foldable or hard plastic, such that the packing material can be held back in the sleeve so that the stick can be pressed out of the packing material by the pusher body.

In one embodiment the pusher body is packed in the envelope together with the stick. This can be advantageous if the stick must be retractable, so that the pusher body can be firmly connected beforehand to the stick.

In another embodiment including a screw spindle as previously described, the screw spindle has a length at least equal to the length of the stick, and the free end of the spindle is pointed. With this embodiment it is possible to rotate the stick not only through the nut body but also through the stick material such that the tip of the screw spindle pierces the front end of the packaging and thereby opens the packaging.

If the packaging envelope is of relatively hard material, in another embodiment the envelope is provided with a cylindrical space in which the stick is received as well as the nut body which functions as a piston. As a result there will be no loss of relatively thin spreadable material.

The packaging material is of foldable material in another embodiment, whereby the packaging material is stripped from along the stick as the stick is used.

The packaging material, in yet another embodiment is, of transparent plastic, wherein it is preferred to provide a window in the sleeve to permit the user to see how much product is still present in the sleeve.

In a preferred embodiment of the invention, for easy handling and easy refilling of the sleeve it includes two shell parts which close onto each other.

BRIEF DESCRIPTION OF THE DRAWINGS

Various embodiments of the present invention are described and illustrated below with reference to the drawings, in which like items are identified by the same reference designation, wherein.

DETAILED DESCRIPTION OF THE INVENTION

Figure 1:
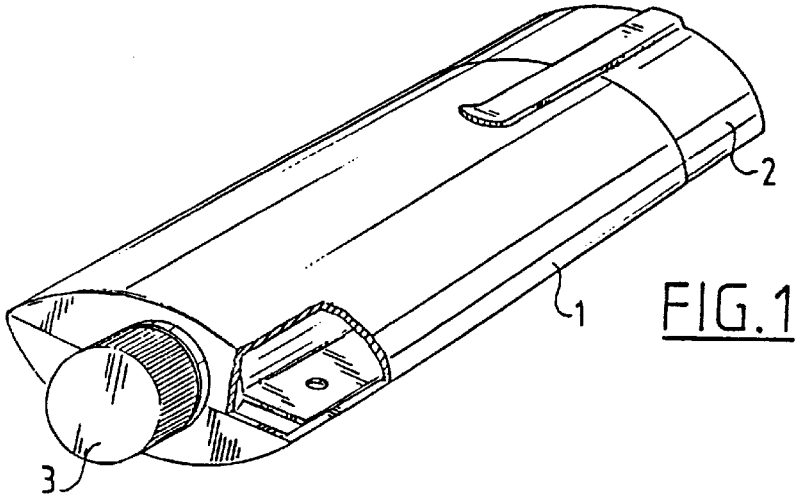
FIG. 1 shows a perspective view of a first embodiment of a sleeve according to the invention suitable for a consumer stick product.

In FIG. 1 a sleeve 1 is shown in which a refill stick of spreadable material can be received. The sleeve 1 is provided with a closure cap 2 in addition to a hand-operated element 3 protruding at the other end.

Figure 2:
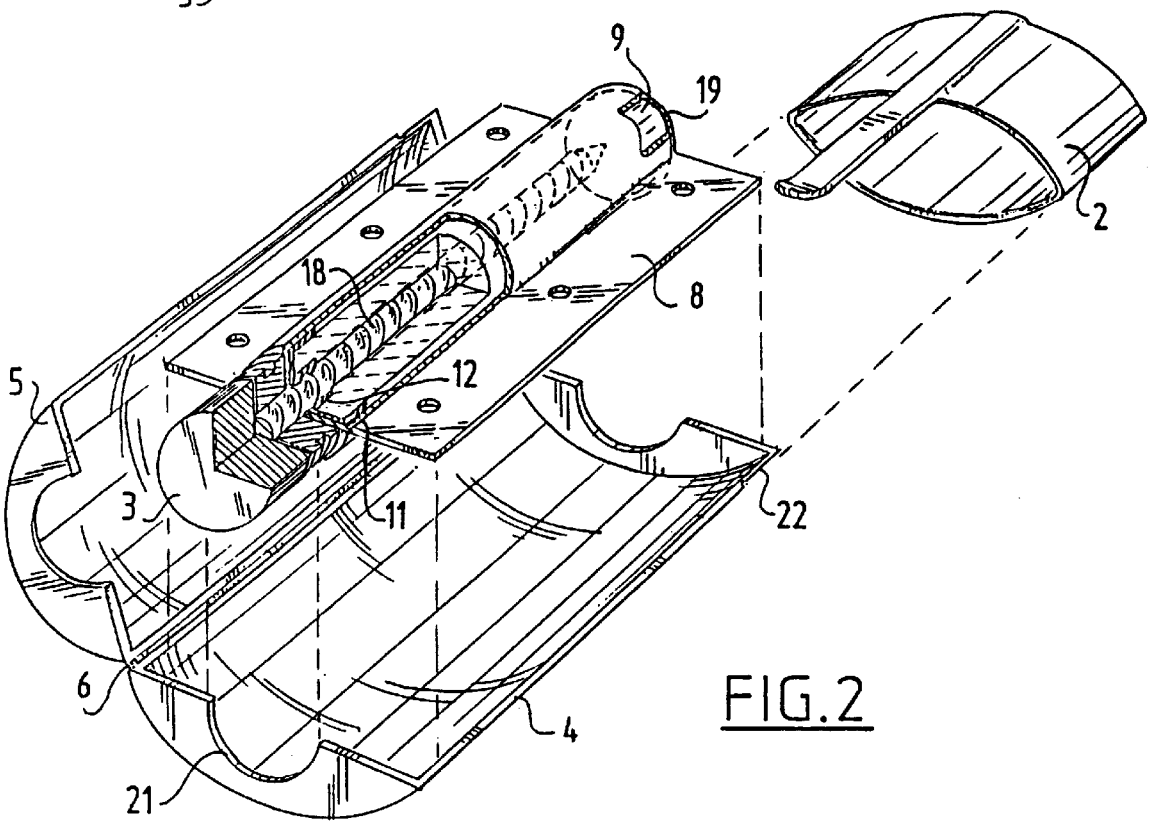
FIG. 2 is a perspective view of the sleeve of FIG. 1, with the shell parts of the sleeve folded open, and a stick with associated packaging placeable therein.

The sleeve 1 consists of two shell parts 4, 5, respectively, as shown in FIG. 2, which are hingedly connected to each other on one side at 6 and which can be closed onto each other by a snap connection of conventional form.

The inner space of the shell parts is such that the refill packaging 8 in which a stick 9 of spreadable material is accommodated is wholly encased by the shell parts 4 and 5.

Figure 3:
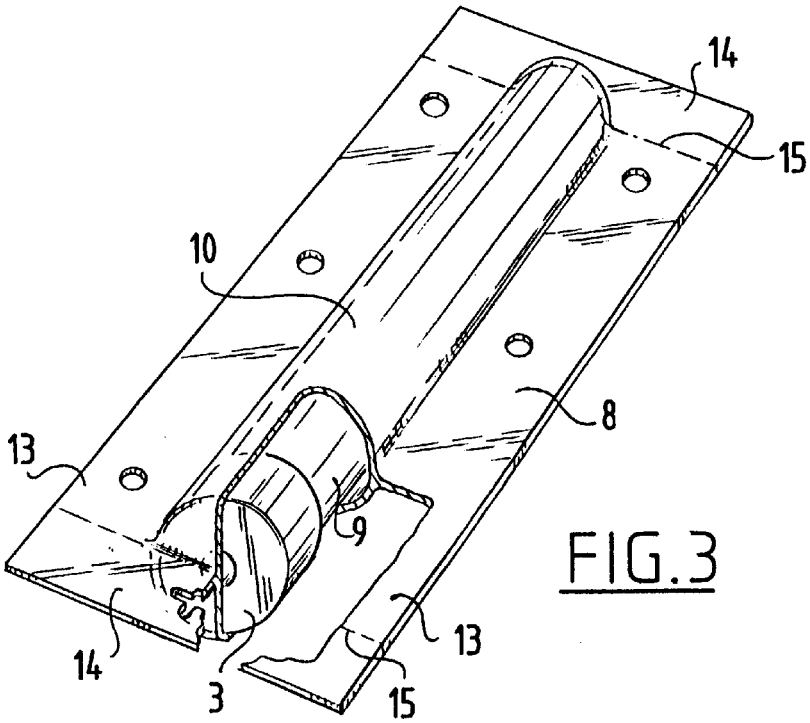
FIG. 3 shows a perspective view of the stick which is packed according to the invention with the nut body.
Figure 4:
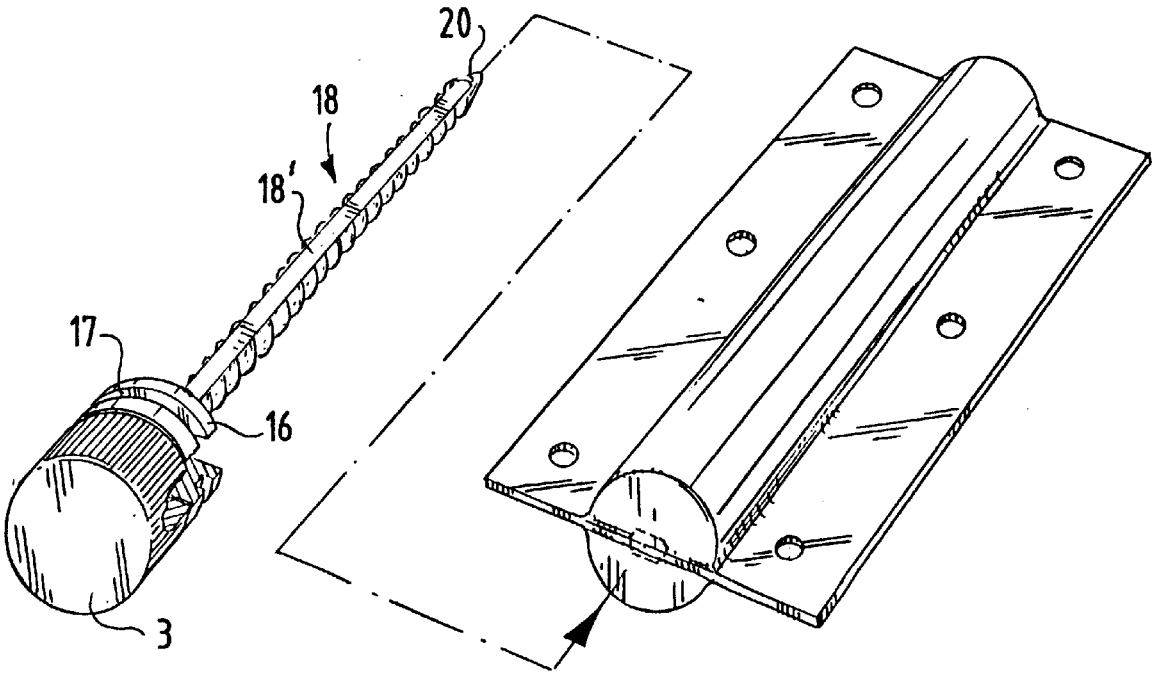
FIG. 4 shows a perspective view of the packaging of FIG. 3 into which the hand-operated screw element must be carried.

The packaging 8 is further elucidated in FIGS. 3 and 4. Packaging 8 has a cylindrical space 10 for receiving the stick material 9. On one end the space is likewise filled with a nut body 11 to be further elucidated below. Nut body 11 is cup-shaped, see FIG. 2, which cup has a central bushing 12 with an internal screw thread. The cup-like shape of nut body 11 can bring about a firm connection to the material of stick 9. As shown in FIG. 3, the free end of the nut body 11 is flat, and includes a centrally located hole.

The packaging 8 further comprises two side wings 13 in addition to front and rear wings 14 which can be torn from the central packaging by means of a tear line 15. The front and rear end are thus exposed and the nut body 11 left clear as well as the open end on the opposite side.

The hand-operated element 3 here takes the form of a rotary knob onto which connects an annular bearing part 16 with a peripheral groove 17.

The sleeve 1 of FIG. 1 is refillable in the following manner.

First the shell parts are opened as shown in FIG. 2. The user will then prepare the packaging of FIG. 3 by removing the end wings 14 by tearing them off. The screw spindle 18, which is fixed to the hand-operated element 3, is subsequently carried through the bushing 12 with internal screw thread and likewise through the material of the stick 9. The user rotates this spindle so far that the end stop 19 of the stick is pressed away and the opening cleared. It is also possible for the end stop 19 to be bored through by the tip 20 of the screw spindle.

At this stage the configuration according to FIG. 2 is reached and the packaging can be laid with the hand-operated element 3 into the lower shell half 4, wherein care must be taken that the peripheral groove 17 of ring 16 comes to lie in the semicircular recess 21 of the lower shell half. After closing the upper shell half 5 onto the lower shell half 4 the configuration according to FIG. 1 is obtained and the cap 2 can be placed on the narrowed end portion 22 of the shell.

Ring 16 is connected to a screw spindle 18, the screw thread of which corresponds with the internal screw thread of bushing 12. The screw spindle 18 is provided with a point 20 on the free end thereof.

When the packaging 8 is used only the cap 2 has to be removed and the knob 3 turned far enough to cause a portion of the stick 9 to protrude from the sleeve 1 so that the stick 9 can be used. Each time the knob 3 is turned in an appropriate direction the nut-like body 11 slides forward, whereby body 11 fits closely into the cylindrical space of the packaging and therefore functions as a kind of piston.

After use, the stick 9 can be retracted into the packaging 8 by turning the screw knob 3 in the opposite direction.

Finally, once the whole stick 9 has been used up, only the packaging 8 is discarded after the screw spindle 18 has been rotated out.

In FIG. 4 the screw spindle 18 is embodied with two flat sides 18' lying diametrically opposite each other and co-acting with two flattened sides in nut body 11. With correct positioning of the nut body relative to the screw spindle 18, the spindle 18 can thus be shifted along the nut body 11 without rotation, which facilitates assembly.

Figure 5:
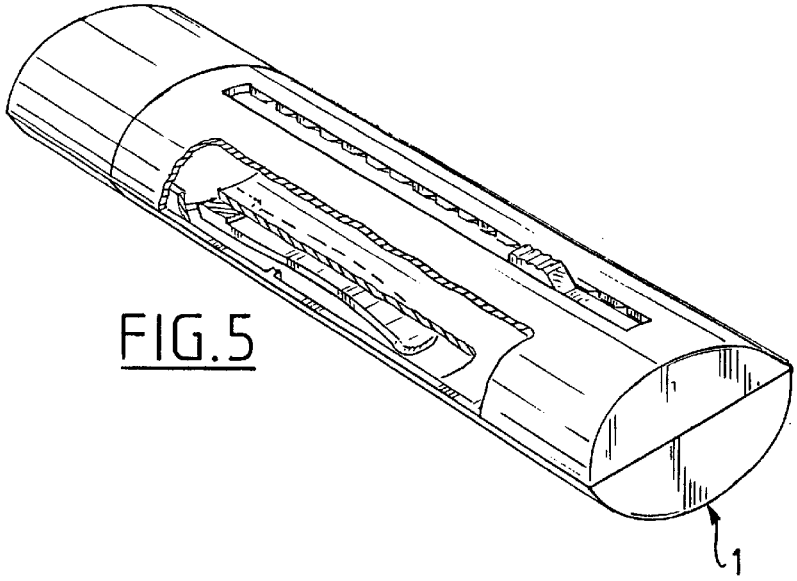
FIG. 5 shows a perspective view of a second embodiment of a sleeve according to the invention.
Figure 6:
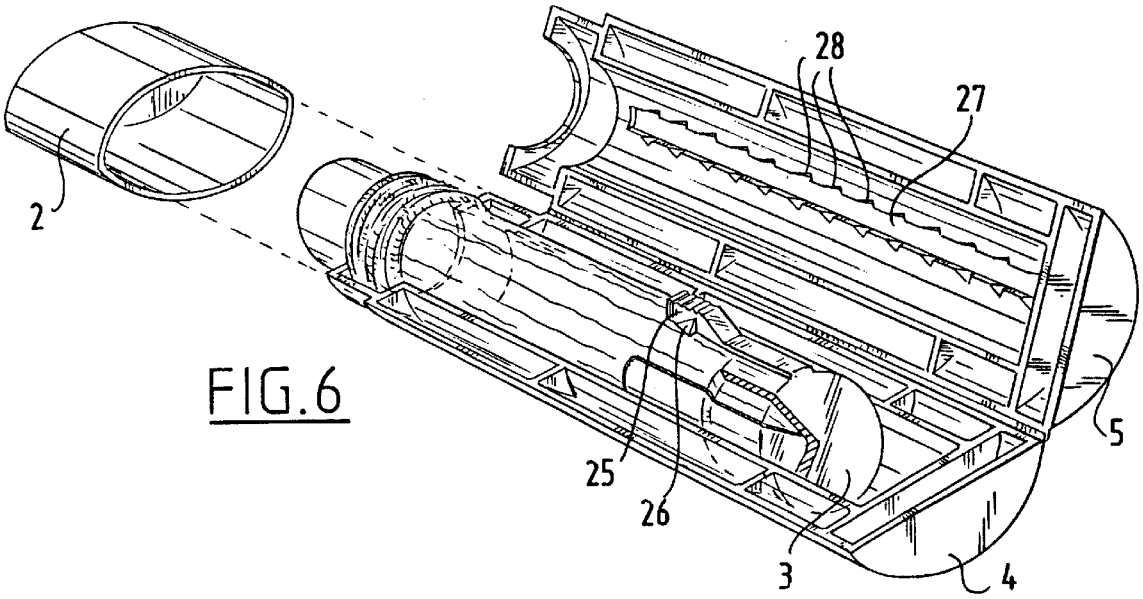
FIG. 6 is a perspective view of the sleeve of FIG. 5 with shell parts folded open and a refill stick arranged therein.
Figure 7:
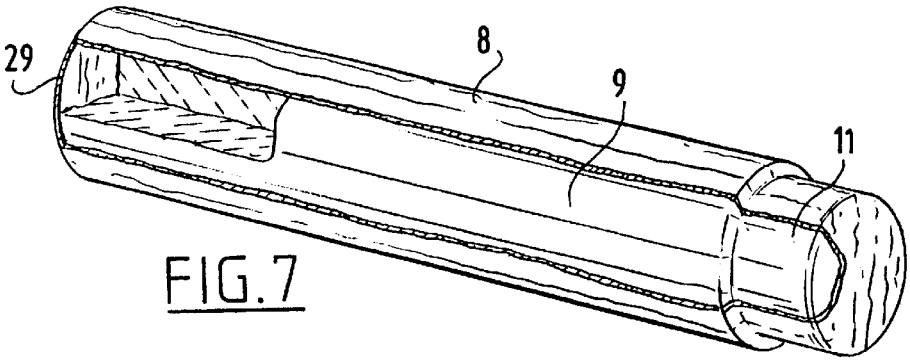
FIG. 7 shows a perspective view of the packaged stick suitable for use; in the second embodiment according to FIG. 5, FIGS. 8 and 9 each show a perspective view of a third embodiment with a sleeve constructed from annular parts.

A description of a second embodiment with reference to FIG. 5–7 is given immediately below.

Here also the sleeve 1 is embodied as two shell-like parts 4 and 5 hingedly connected to each other on the lengthwise edge 6.

The stick 9 is packed in a plastic foil of foldable material and together with the pusher body 11, for example.

The hand-operated element 3 takes the form in this example of a cap which fits round the narrowed part 11 of the packaging 8, and which is provided with a grip 25 with locking cams 26. This grip 25 in the form of an elongate arm co-acts with a slot-like recess 27 in the upper shell part 5. The lengthwise edges of recess 27 are provided with notches 28 into which the cams 26 of arm 25 fall or follow.

This embodiment is used as follows. The user must open the packaging according to FIG. 7 on the side remote from pusher body 11 by cutting off the sealing wall 29. The user then places the cap 3 on pusher body 11 and arranges this configuration in the lower shell half 4 such that the arm 25 protrudes through window 27.

The user has only to push in the arm 25 and ensure that the cam 26 falls into the following notch 28 of the slot-like opening 27, whereby a movement of the cap part 3 and therefore the pusher body 11 takes place in the direction of the open end of sleeve 1. The stick 9 is thus shifted outward, while the foldable packaging is stripped off at the open end by the detaining means of sleeve 1. A closure cap 2 can be installed over the open end after use to prevent the stick 9 from drying out.

For refilling purposes it is only necessary to discard and replace the packaging 8 of FIG. 7.

Figure 8:
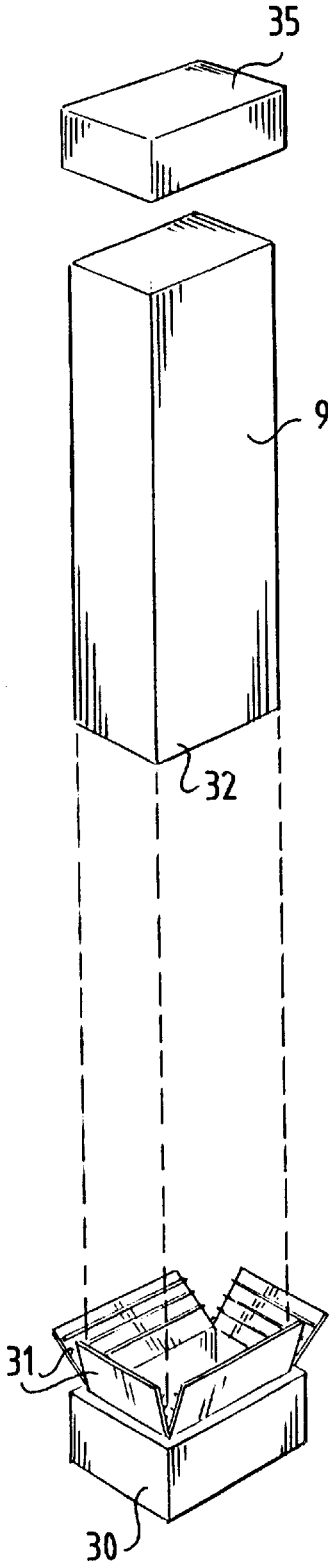
Figure 9:
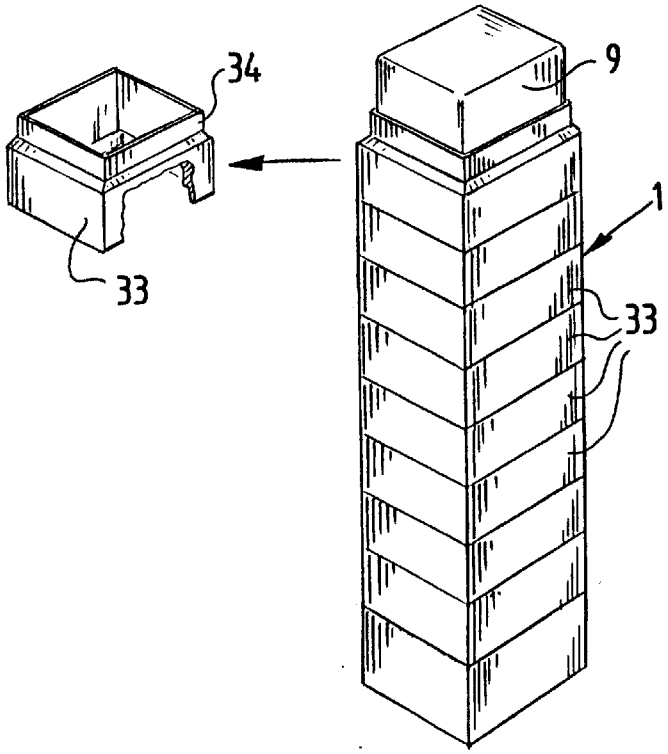

With reference to the embodiment of FIGS. 8 and 9 is noted that here the stick element 30 is formed as a clamping member provided with clamping lips 31 with a toothed inner surface, such that the bottom end 32 of stick 9 can be placed on the element 30, wherein the lips 31 are folded inward, whereby the toothed inner surface comes to lie against the side of the stick and penetrates therein. The sleeve 1 can then be constructed of annular parts 33 which are shown in detail on the left in FIG. 9. Due to the upright collar 34, the lower edge of the ring 33 located above drops over flange 34, and the sleeve 1 can thus be formed by stacking the annular parts 33 one on top of another. The ring following on from stick element 30 comprises the lips 31 so that a firm connection is effected between stick 9 and the sleeve 1. As the stick 9 is used one annular part 1 at a time can be removed so that the stick 9 can be used up completely. A new stick 9 can again be clamped fixedly and the sleeve 1 can be reconstructed from the annular parts 33, so that a refillable device is obtained. A cap 35 is placed on the top ring to prevent drying.

Figure 10:
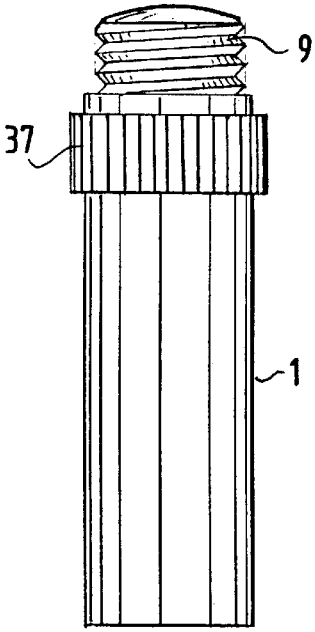
FIGS. 10 and 11 show respectively a standing side view and a cross section of a fourth embodiment, wherein an external threaded body releases the stick.
Figure 11:
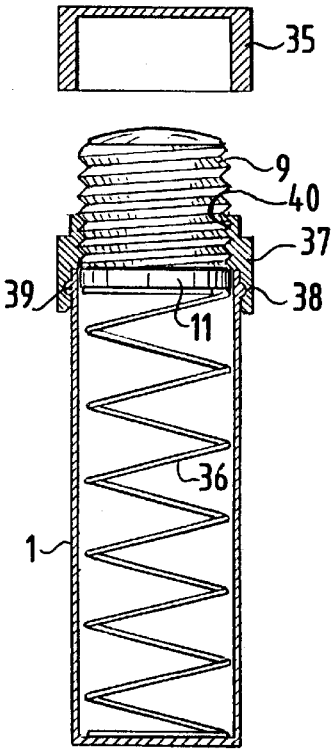

FIGS. 10 and 11 show an embodiment wherein use is made of a fixed sleeve 1 in which is accommodated a pusher body 11. The outer periphery of pusher body 11 fits inside the cylindrical inner casing of sleeve 1. A pressure spring 36 is placed between the bottom of sleeve 1 and the pusher body 11, wherein a threaded ring 37 is mounted rotatably on the open top side of sleeve 1. Threaded ring 37 is provided with a groove 38 which fits around an annular cam 39 of sleeve 1 arranged along the upper edge. The threaded ring 37 is provided on the inside with a screw thread 40.

The stick 9 is arranged in sleeve 1 while pressing down the pusher body 11 and compressing the spring 36. The stick 9 has a threaded body, as shown, which is initially separate of sleeve 1 and includes the ring 37 provided with screw thread 40, is then snapped over the annular cam 39 by means of the groove 38. The spring 36 will press upward the stick 9 which will be held back by screw thread 40. By turning ring 37 the stick nevertheless moves outward and, with further turning, can be carried continuously outside of the sleeve and used. By turning ring 37 in the opposite direction the stick can be pressed inward again. A cap 35 can be installed over stick 9 and to prevent drying out.

The stick 9 can be replaced with a new stick by removing the ring 37, whereafter the above stated operation can be repeated.

Figure 12:
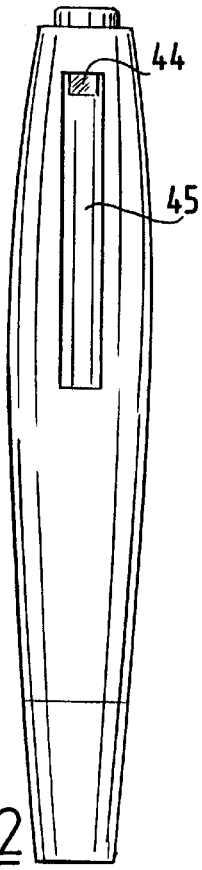
FIGS. 12 and 13 show respectively a standing side view and a cross section of a fifth embodiment, wherein the pusher body can be fixed exchangeably to the screw spindle.
Figure 13:
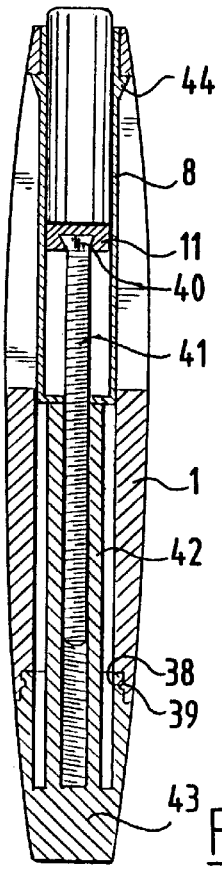

FIGS. 12 and 13 show an embodiment wherein the pusher body 11 is received in the packaging 8 of slightly stiff material which may or may not be manufactured from transparent material. A pusher body 11 is received in the packaging 8. Pusher body 11 is movable upward and downward in packaging 8 by being coupled beforehand to a head 40, rectangular in top view, of a screw spindle 41. This screw spindle is received in an inner threaded bushing 42 which is coupled at the bottom end to a hand-operated member 43. The latter is connected via a tongue/groove connection 38, 39 to the underside of the sleeve 1. The packaging 8 is embodied close to the top end with two protruding cams 44 which fit into lengthwise slots 45 of sleeve 1, thus preventing rotation of packaging 8 relative to the sleeve. A fixing or rigid securement of packaging 8 in sleeve 1 is also realized.

After the stick 9 present in packaging 8 has been used up, which stick 9 is pressed outward through the top open end of the sleeve 1, a new stick 9 with packaging 8 can be arranged by disconnecting the pusher body 11 from the upper end 40 of the screw 41.

Figure 14:
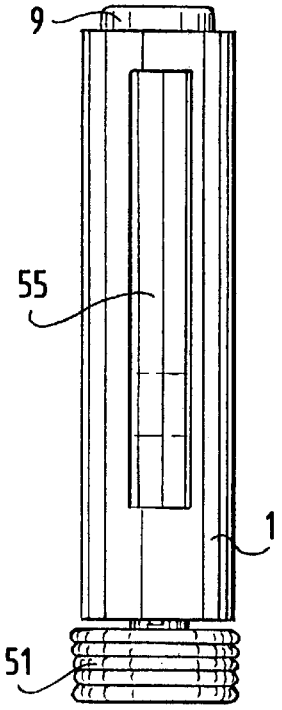
FIGS. 14 and 15 show respectively a standing side view and a cross section of a sixth embodiment with a toothed pusher spindle as displacing member for the pusher body.
Figure 15:
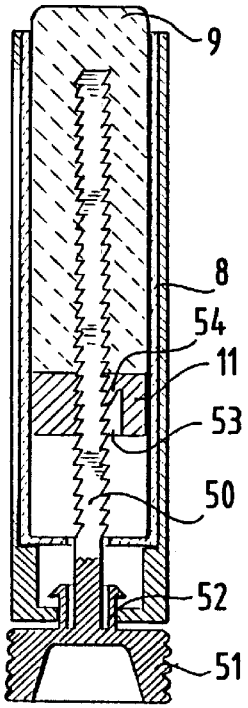

FIGS. 14 and 15 show an embodiment wherein the pusher body 11, which is again arranged in the packaging 8 of a stick, co-acts with a pusher spindle 50 which is mounted for axial sliding in the sleeve 1. To this end the pusher spindle 50 is connected on the underside to a hand-operated element 51 which is provided with a bushing 52 arranged for axial sliding in a central hole on the underside of sleeve 1. Bushing 52 has a length such that the pressure member 51 can make a determined stroke sufficient to span a distance greater than the pitch distance of the teeth on either side of spindle 50. The pusher body 11 is provided with a thru hole 53 in which is arranged a resilient lip 54. Each time the spindle 50 is moved the pusher body 11 is shifted upward a pitch distance and the stick 9 resting thereon is pressed outward.

After the stick 9 has been spent, the empty packaging 8 can be removed from sleeve 1 and be replaced with a full packaging 8. A window 55 in sleeve 1 shows the extent the stick 9 has been used up.

Figure 16:
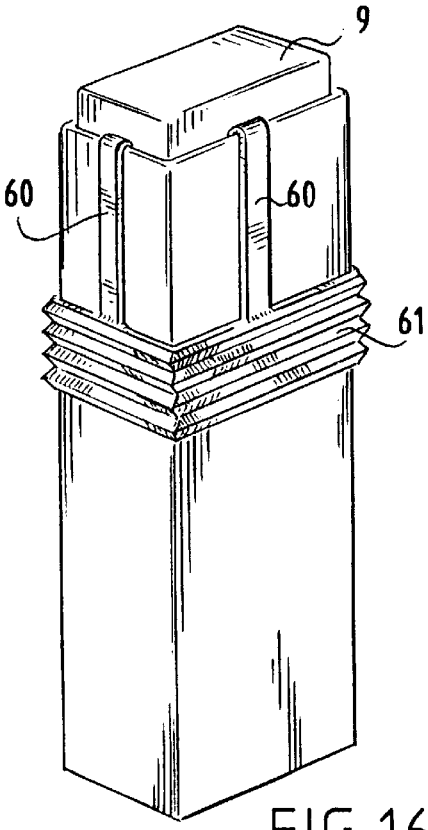
FIGS. 16 and 17 show respectively a perspective view and a standing cross section of a seventh embodiment, wherein the pusher body is connected with strips to an external hand-operated member.
Figure 17:
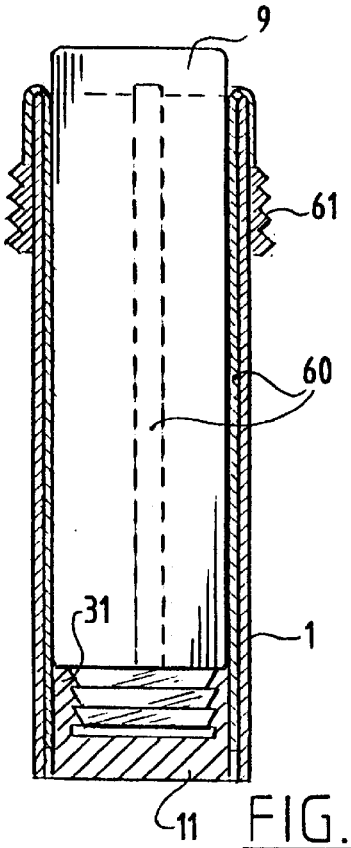

FIGS. 16 and 17 show an embodiment wherein the pusher body 11 is received slidably in the cylindrical sleeve 1.

The pusher body 11 can again be provided with lips 31 with a tooth-like inner surface for receiving the bottom end of a stick 9. The pusher body 11 is connected via strips 60 to a member 61 operated for upward and downward sliding on the outside of sleeve 1. The sleeve 1, in this example, has either a round or rectangular or polygonal section, wherein a strip 60 is guided over each face and trained over the upper edge of sleeve 1.

It will be apparent that when the hand-operated member 61 is pulled downward the flexible strips 60 are pulled over the edge of the sleeve 1 carrying upward therewith the pressure member 11. In this way a stick 9 coupled to pusher body 11 will be slid out of the sleeve 1, whereafter it can then be used.

A refill stick 9 can be connected again to the pusher body 11 in the above described manner.

Figure 18:
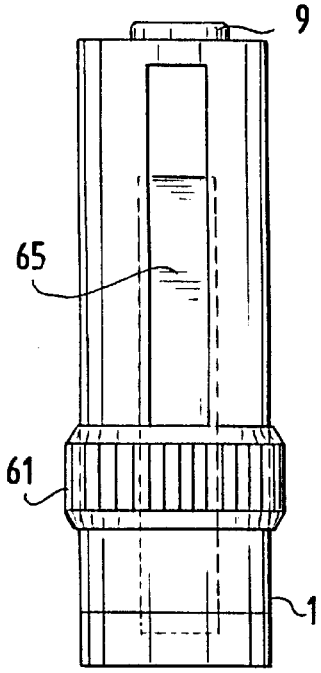
FIGS. 18 and 19 show respectively a standing side view and a cross section of an eighth embodiment, wherein the pusher body is coupled with pushing strips to the external operating member.
Figure 19:
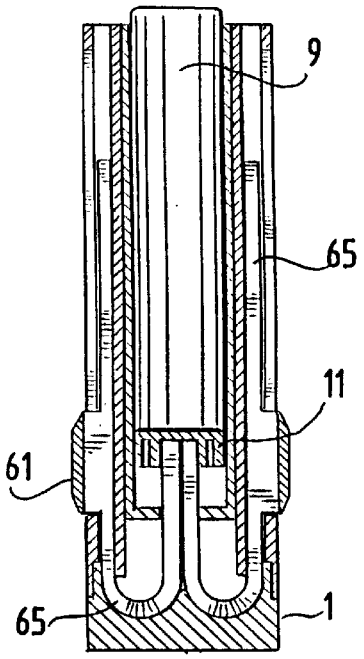

FIGS. 18 and 19 show a variant of the flexible strips, wherein the pusher body 11 is connected via pressure strips 65 to a hand-operated element 61 slidable along the outside of sleeve 1. By sliding the hand-operated element 61 up and downward the pressure strips 65 are carried along and will push up the pusher body 11, carrying along a stick 9 placed thereon.

In a preferred embodiment, the bottom of sleeve 1 must be provided with a semicircular guide to allow the pressure strips 65 to bend without disruption.

Figure 20:
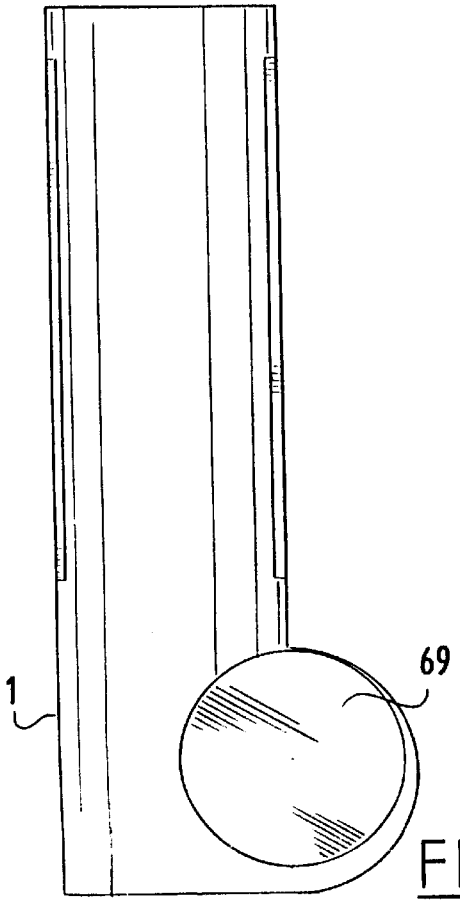
FIGS. 20 and 21 show respectively a standing side view and a standing cross section of a ninth embodiment, wherein the pusher body is connected via a push chain to the external control member.
Figure 21:
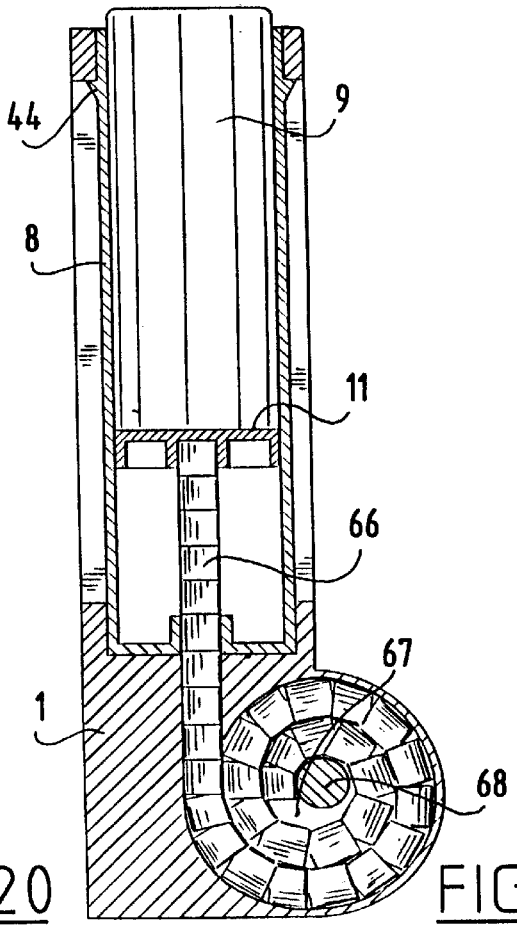

FIGS. 20 and 21 show a variant embodiment of the pressure strip in the form of a pressure chain 66, which strikes against the underside of the pusher body 11 when the chain is rotated in clockwise direction from a supply. The supply takes the form here of a chamber 67 which forms part of the sleeve 1. By connecting the spindle 68 of the chain to a rotatable knob 69 located outside sleeve 1 the stick 9 placed on pusher body 11 can be pressed out of sleeve 1, with a simple manual operation of rotating knob 69.

In this and foregoing embodiments the stick 9 can be arranged in a packaging 8 which is securely and captively held in sleeve 1 by means of lips 44.

After stick 9 has been spent, the associated packaging 8 can be removed and replaced by a new, filled packaging 8.

A new pusher body 11 is also included in the refill packaging 8, for making it replaceable. Refilling of the sleeve 1 is implemented by rewinding the chain 67 around the spindle 68.

Although various embodiments of the invention have been shown and described herein, they are not meant to be limiting. Those of skill in the art may recognize certain modifications to these embodiments, which modifications are meant to be covered by the spirit and scope of the appended claims.

We claim:

1. A refillable applicator for a stick of spreadable substance comprising:

an elongated hollow sleeve formed by hinged shells that has a first opening at one end, and a second opening at another end opposing said one end;

a refill package operatively contained within the sleeve, said refill package including a stick of the spreadable substance, and a nut body accessible from the exterior of said refill package at a first end thereof for advancing said stick of spreadable material through both a second end of the refill package, and said second opening of said sleeve, said refill package further including packaging material formed to provide a centrally located cylindrical section for enclosing said stick of spreadable material and said nut body, a pair of relatively thin side wing sections extending radially from opposing sides of said cylindrical section for at least the length of said cylindrical section, and a pair of relatively thin end wings extending from opposite ends of said cylindrical section as an extension of and in the same plane as said side wing sections;

a manually rotatable knob having an exterior portion protruding from the exterior of said first opening of said sleeve, said knob being rotatively and captively retained by said hinged shells when closed; and a spindle having one end attached to the center of an interior end portion of said knob, said spindle having external threads embedded in said stick and threaded through a centrally located hole in said nut body;

whereby turning the knob causes the nut body to move along said spindle toward said second end of said refill package to push at least a portion of said stick of spreadable material out of said second opening of said sleeve, and when said spreadable material is spent, said refill package with said nut body as a single unit is removable from said sleeve and spindle by opening the shells thereof, thereby permitting a fresh said refill package to be installed in said applicator.

2. A refillable applicator as set forth in claim 1, wherein the sleeve further includes means for operatively engaging the refill package to secure the latter therein when the hinged shells are closed upon one another.

3. A refillable applicator as set forth in claim 1, wherein said refill package includes a cylindrical space for containing said nut body attached to an end of said stick of spreadable material.

4. A refillable applicator as set forth in claim 1, wherein the spindle has a length at least equal to the length of the stick.

5. A refillable applicator as set forth in claim 1, wherein the spindle includes a remote end, said remote end having a tapered tip.

6. A refillable applicator of a spreadable substance in stick form comprising:

a hollow sleeve formed by a pair of elongated shells, said sleeve having a longitudinal axis;

hinges formed between juxtaposed sides of said shells, and end walls formed at each end of each of said shells, said end walls being perpendicular to said axis;

semi-circular openings formed in each of said end walls such that when said shells are closed, they respectively form circular apertures centered on said axis at opposite ends of said sleeve;

a refill package including a cylindrical cavity having opposing first and second ends;

means for mounting said refill package in said hollow sleeve so that said first and second ends are respectively in registration with said apertures;

a stick of spreadable material contained in said cylindrical cavity;

a nut body mounted within said cylindrical cavity, said nut body having one end attached to an end of said stick and having internal threads;

said nut body having a flat external end surface;

a spindle threaded through the threads of said nut body, and embedded in said stick;

a knob attached to a free end of said spindle;

said knob including means for removably retaining said knob within a circular aperture at one end of said sleeve with a portion of said knob protruding from said sleeve permitting said knob to be turned in a direction for moving said spindle to advance said nut for pushing said stick out of an opposing end of said sleeve.

7. A refill package for use in an applicator comprising:

a cylindrical stick of spreadable material having a longitudinal axis;

a nut body attached to one end of said cylindrical stick;

said nut body having centrally located internal threads parallel to said axis with a centrally located hole for access to said internal threads;

a knob;

a threaded spindle attached to said knob, said spindle being embedded along the axis of said cylindrical stick and threadedly engaged with said nut body;

a bearing coaxial with said spindle between said nut body and said knob; and packaging material formed to provide a centrally located cylindrical section for enclosing said cylindrical stick and said nut body, a pair of relatively thin side wing sections extending radially from opposing sides of said cylindrical section for at least the length of said cylindrical section, and a pair of relatively thin end wings extending from opposite ends of said cylindrical section as an extension of and in the same plane as said side wing sections.

8. A package as set forth in claim 7, further comprising:

tear lines perpendicular to the longitudinal axis of said cylindrical section, and so located along the axis as to expose a free end of the nut body, and to expose the end of the cylindrical stick that is remote from the nut body when the packaging material is torn along said tear lines.

* * * * *